US009488039B2

(12) United States Patent
Eliseev

(10) Patent No.: US 9,488,039 B2
(45) Date of Patent: Nov. 8, 2016

(54) MULTI-ZONE SINGLE TREATMENT GRAVEL PACK SYSTEM

(71) Applicant: Vasily G. Eliseev, Richmond, TX (US)

(72) Inventor: Vasily G. Eliseev, Richmond, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 144 days.

(21) Appl. No.: 14/323,172

(22) Filed: Jul. 3, 2014

(65) Prior Publication Data

US 2016/0003013 A1 Jan. 7, 2016

(51) Int. Cl.

| | |
|---|---|
| ***E21B 43/04*** | (2006.01) |
| ***E21B 43/14*** | (2006.01) |
| ***E21B 34/14*** | (2006.01) |
| ***E21B 33/124*** | (2006.01) |

(52) U.S. Cl.

CPC ..... *E21B 43/14* (2013.01); *E21B 33/124* (2013.01); *E21B 34/14* (2013.01); *E21B 43/04* (2013.01)

(58) Field of Classification Search

CPC ..... E21B 43/04; E21B 43/045; E21B 34/14; E21B 33/124

See application file for complete search history.

(56) References Cited

U.S. PATENT DOCUMENTS

| | | | | |
|---|---|---|---|---|
| 5,577,559 | A | 11/1996 | Voll et al. | |
| 6,446,729 | B1 * | 9/2002 | Bixenman | E21B 33/124 166/205 |
| 6,640,897 | B1 | 11/2003 | Misselbrook et al. | |
| 8,151,883 | B2 * | 4/2012 | Simancas | E21B 33/124 166/278 |
| 8,267,173 | B2 * | 9/2012 | Clarkson | E21B 43/04 166/205 |
| 9,194,217 | B2 * | 11/2015 | Watson | E21B 34/06 |
| 2004/0069489 | A1 | 4/2004 | Corbett | |
| 2006/0060352 | A1 * | 3/2006 | Vidrine | E21B 43/045 166/276 |
| 2007/0051507 | A1 * | 3/2007 | Ross | E21B 34/06 166/51 |
| 2008/0110620 | A1 | 5/2008 | Penno | |
| 2010/0294495 | A1 * | 11/2010 | Clarkson | E21B 43/267 166/278 |
| 2010/0300687 | A1 * | 12/2010 | Watson | E21B 34/06 166/278 |
| 2012/0097386 | A1 * | 4/2012 | Ward | E21B 34/10 166/192 |
| 2013/0180709 | A1 * | 7/2013 | Ritter | E21B 43/12 166/247 |

(Continued)

FOREIGN PATENT DOCUMENTS

| | | |
|---|---|---|
| EP | 0430389 A1 | 6/1991 |

OTHER PUBLICATIONS

Baker Oil Tools, "Baker Model SB-RM Hydro Set Retainer Production Packer with Integral Annulus Flow Sleeve (AFS): Product Family No. H40950", Packer Systems Technical Unit, Oct. 1, 2003, pp. 1-15.

(Continued)

*Primary Examiner* — Shane Bomar

(74) *Attorney, Agent, or Firm* — Cantor Colburn LLP

(57) ABSTRACT

A gravel pack system includes a tool string having an inner string member, an outer string member, and a passage arranged between the outer string member and the inner string member. A packing element is provided on the outer string member. A first valve is coupled to one of the outer string member and the inner string member outwardly of the packing element in a downhole direction. The first valve fluidically connects the passage and the open hole wellbore. The first valve is configured and disposed to shift from a closed position to an open position. A second valve is coupled to one of the outer string member and the inner string member outwardly of the packing element in an uphole direction. The second valve selectively fluidically connects the passage and the open hole wellbore. The second valve shifts from an open position to a closed position.

18 Claims, 9 Drawing Sheets

(56) References Cited

U.S. PATENT DOCUMENTS

| | | | | |
|---|---|---|---|---|
| 2013/0213647 | A1* | 8/2013 | Roddy | E21B 47/01 166/255.1 |
| 2013/0277051 | A1 | 10/2013 | Vlasko | |

OTHER PUBLICATIONS

International Search Report and Written Opinion of the International Search Authority issued in related PCT Patent Application No. PCT/US2015/036865 on Sep. 7, 2015, 9 pages.

* cited by examiner

MULTI-ZONE SINGLE TREATMENT GRAVEL PACK SYSTEM

BACKGROUND

In a wellbore, it may be desirable to enhance structural integrity at desirable zone(s). Conventionally, structural integrity of wellbore walls is enhanced with a gravel pack. Current treatment systems establish a gravel pack across all zones, both desirable and undesirable. Following the gravel pack, an undesirable zone may be isolated from a desirable zone by deploying packing elements. Current systems for gravel packing multiple zones typically require multiple treatments performed sequentially with associated multiple trips into the wellbore.

SUMMARY

A multi-zone single treatment gravel pack system includes a tool string having an inner string member, an outer string member, and a passage arranged between the outer string member and the inner string member. At least one selectively deployable packing element is provided on the outer string member. A first valve is coupled to one of the outer string member and the inner string member outwardly of the at least one selectively deployable packing element in a downhole direction. The first valve selectively fluidically connects the passage and the open hole wellbore. The first valve is configured and disposed to shift from a closed position to an open position. A second valve is coupled to one of the outer string member and the inner string member outwardly of the at least one selectively deployable packing element in an uphole direction. The second valve selectively fluidically connects the passage and the open hole wellbore. The second valve is configured and disposed to shift from an open position to a closed position.

A completion system includes an uphole portion having at least one pump and a fluid storage system fluidically connected to the at least one pump, and a downhole portion including a completion string extending into an open hole wellbore. The completion string includes a multi-zone single treatment gravel pack system having a tool string including an inner string member, an outer string member, and a passage arranged between the outer string member and the inner string member, and at least one selectively deployable packing element provided on the outer string member. A first valve is coupled to one of the outer string member and the inner string member axially outwardly of the at least one selectively deployable packing element in a downhole direction. The first valve selectively fluidically connects the passage and the open hole wellbore. The first valve is configured and disposed to shift from a closed position to an open position. A second valve is coupled to one of the outer string member and the inner string member axially outwardly of the at least one selectively deployable packing element in an uphole direction. The second valve selectively fluidically connects the passage and the open hole wellbore. The second valve is configured and disposed to shift from an open position to a closed position.

A method of multi-zone single treatment gravel packing an open hole wellbore includes guiding a completion string, including a gravel pack system, into the open hole wellbore, deploying at least one packing element provided on an outer string member to isolate a portion of the open hole wellbore, opening a first valve arranged outwardly of the at least one packing element in a downhole direction, introducing a downhole fluid into the open hole wellbore, guiding the downhole fluid through openings formed in the outer string member outwardly of the at least one packing element in an uphole direction, passing the downhole fluid radially inwardly along the at least one packing element through a passage arranged between the outer string member and an inner string member, guiding the downhole fluid through the first valve back into the open hole wellbore, and closing a second valve arranged at the openings in the outer string member.

BRIEF DESCRIPTION OF THE DRAWINGS

Referring now to the drawings wherein like elements are numbered alike in the several Figures.

DETAILED DESCRIPTION

Figure 1:
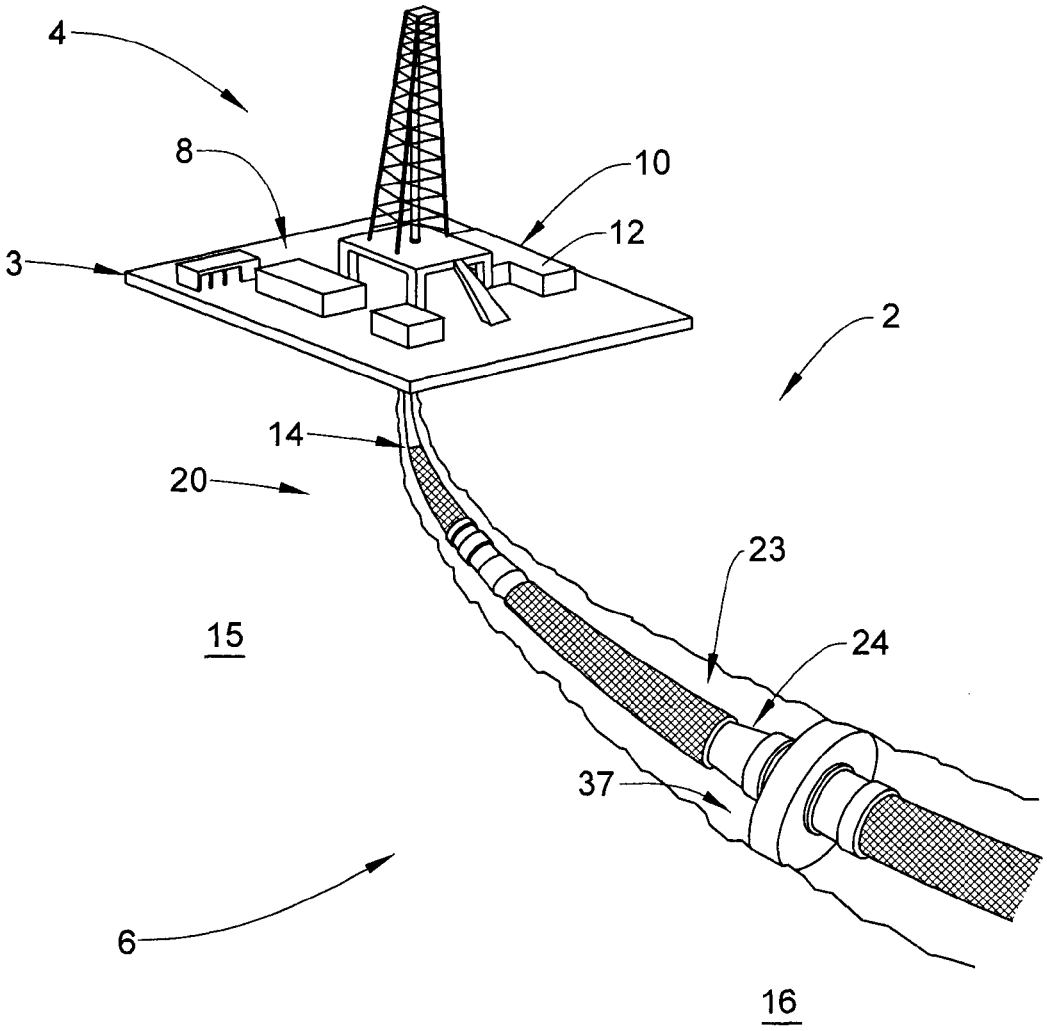
FIG. 1 depicts a resource extraction system including a multi-zone single treatment gravel pack system, in accordance with an exemplary embodiment.

A resource capture system, in accordance with an exemplary embodiment, is illustrated generally at 2, in FIG. 1. Resource capture system 2 is shown in the form of a completion system 3 and includes an uphole portion 4 and a downhole portion 6. Uphole portion 6 includes one or more pumps 8 fluidically connected to a fluid storage system 10 that may hold completion fluids 12 that contain gravel (not separately labeled). As will be discussed more fully below, completion fluids, such as gravel pack fluids, are delivered into an open hole wellbore 14 that may include first and second resource bearing zones 15 and 16. A completion string 20 extends into open hole wellbore 14 to isolate resource bearing zones 15 and 16 and facilitate gravel packing. Gravel packing is performed on interior walls (not separately labeled) of resource bearing zones 15 and 16 of open hole wellbore 14.

Figure 2A:
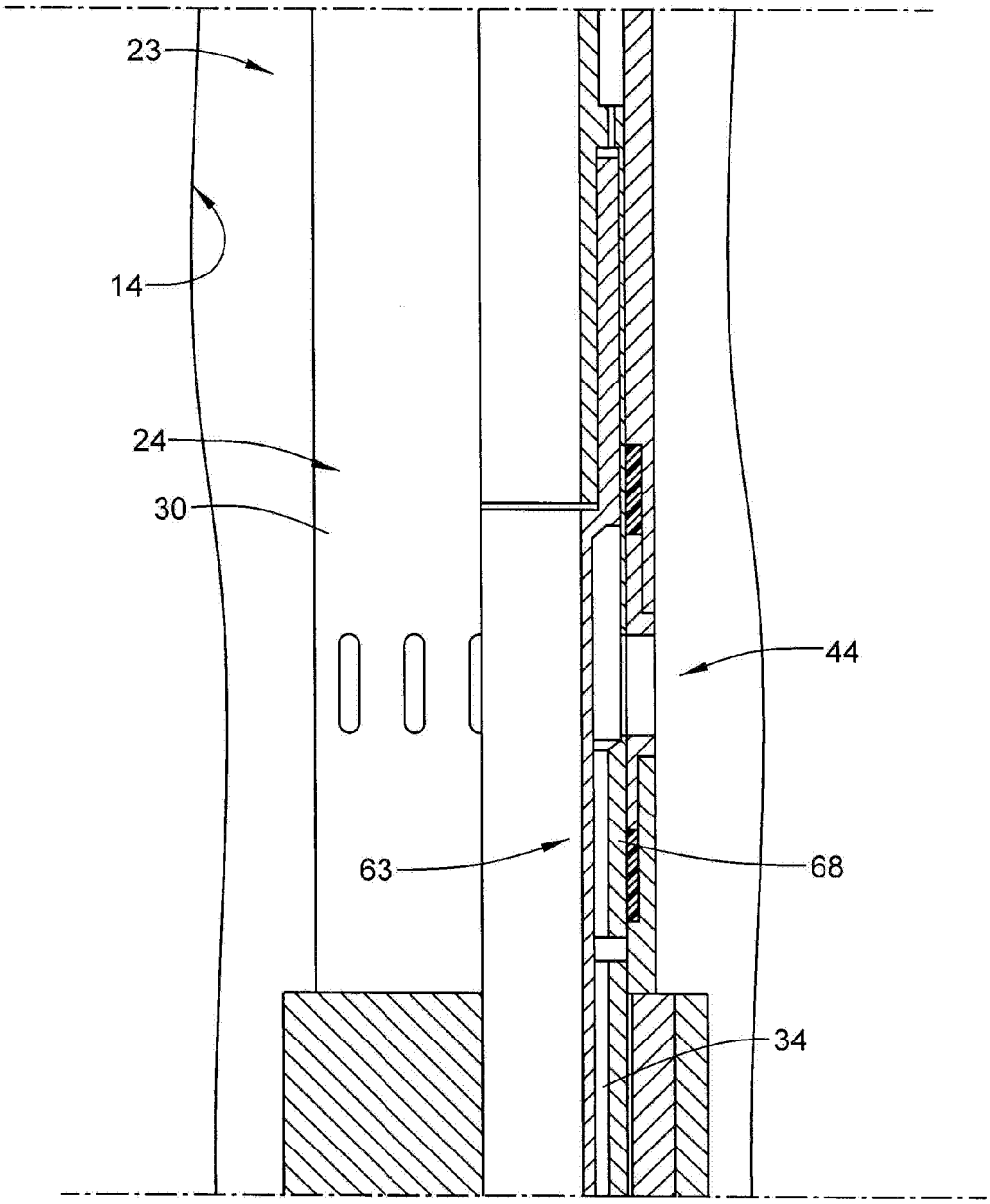
FIG. 2A depicts a partial cross-sectional view of an upstream portion of the multi-zone single treatment gravel pack system of FIG. 1 prior to being run into an open hole wellbore.
Figure 2B:
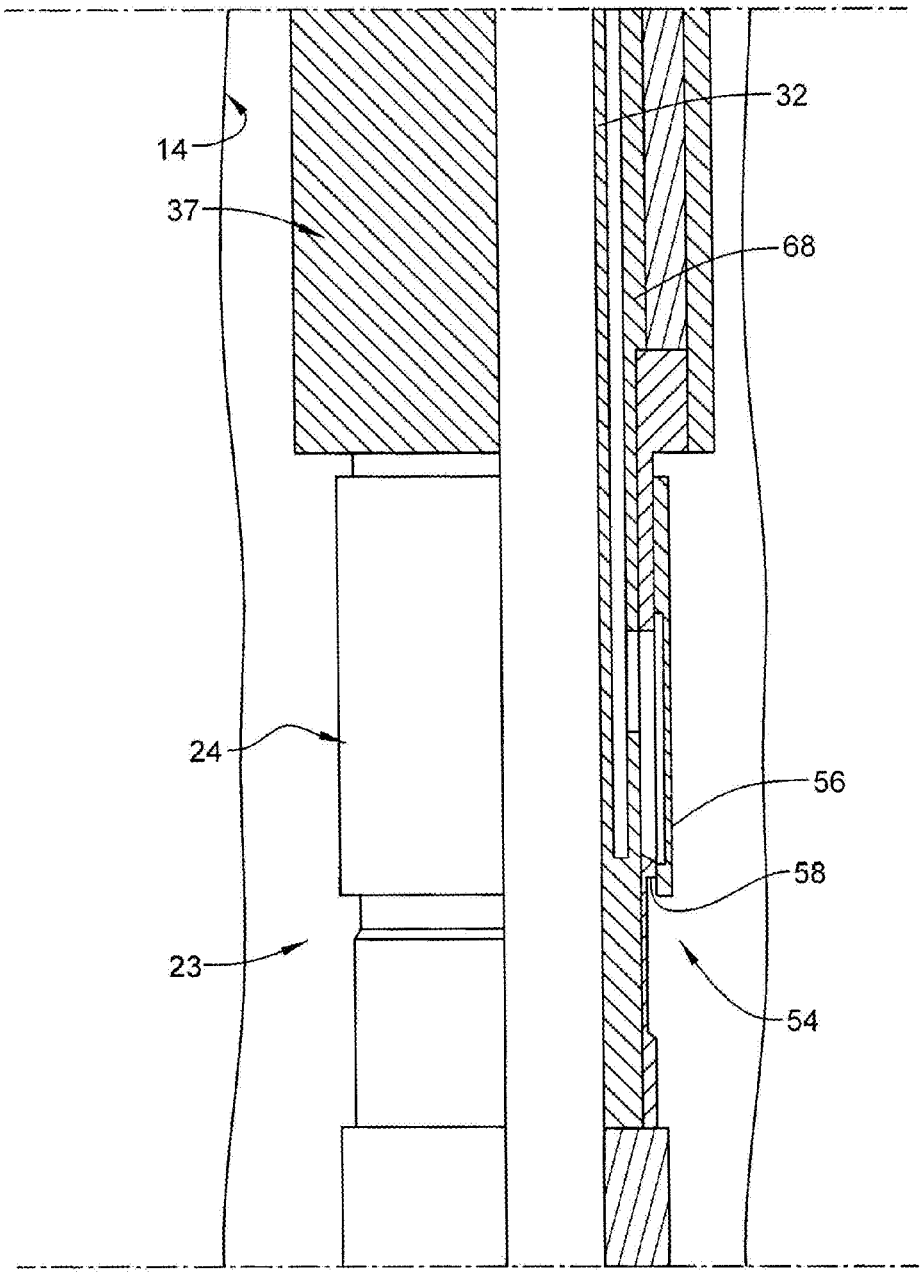
FIG. 2B depicts a partial cross-sectional view of a downstream portion of the multi-zone single treatment gravel pack system of FIG. 1 prior to being run into an open hole wellbore

In accordance with an aspect of an exemplary embodiment illustrated in FIG. 2A and 2B, completion string 20 includes a multi-zone single treatment gravel pack system 23 including a tool string 24. Tool string 24 includes an outer string member 30 and an inner string member 32. Inner string member 32 is spaced from an inner surface (not separately labeled) of outer string member 30 forming a bypass passage 34. A packing element 37 may be mounted to outer string member 30. Outer string member 30 includes a plurality of openings, one of which is shown at 44. Openings 44 extend annularly about outer string member 30.

Figure 3:
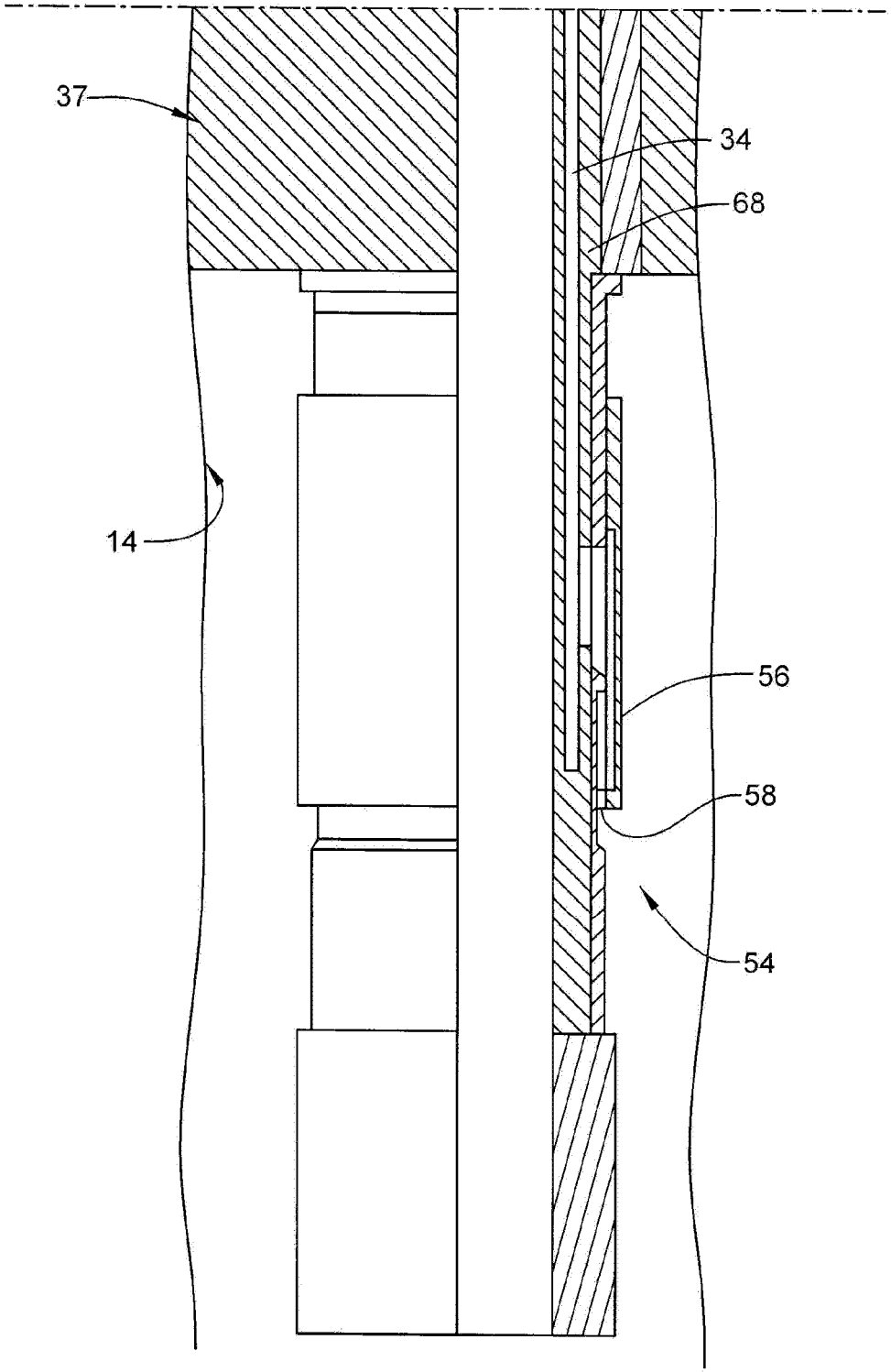
FIG. 3 depicts a partial cross-sectional view of the downstream portion of the multi-zone single treatment gravel pack system of FIG. 2B after being run into an open hole wellbore and a valve opened to allow fluids to flow below a packing element.

In further accordance with an exemplary embodiment, multi-zone single treatment gravel pack system 23 includes a first valve 54 arranged outwardly of packing element 37 in a downhole direction. First valve 54 may be in a normally closed position, such as shown in FIG. 2B, when multi-zone single treatment gravel pack system 23 is guided into open hole wellbore 14 and may be opened, such as shown in FIG. 3, packing element 37 sets against shale layer 19. First valve 54 may be opened by a tool (not shown) used to trigger setting of packing element 37. Of course, it should be understood that first valve 54 may be opened using a wide array of systems including tool based and non-tool based systems. As will be detailed more fully below, first valve 54 fluidically exposes passage 34 to open hole wellbore 14, below or outwardly in a downhole direction, relative to packing element 37. In an open hole environment, high velocity flow passing from completion string 20 could washout/erode open hole wellbore. In order to reduce erosion, first valve 54 may include a shroud member 56 that is shaped to direct fluids passing from passage 34 outwardly and downwardly from an outlet 58 formed in outer string member 30 and into open hole wellbore 14. In this manner, the fluids do not impact wellbore walls (not separately labeled) and erosion is reduced and/or eliminated.

In still further accordance with an exemplary embodiment, gravel pack system 23 includes a second valve 63 arranged at openings 44. Second valve 63 may be part of an isolation sleeve 68 provided in passage 34 or could be provided on outer string member 30 and/or inner string member 32. Second valve 63 may be a normally open valve that fluidically exposes open hole wellbore 14 to passage 34 via openings 44 and is arranged outwardly of packing element 37 in an uphole direction. Second valve 63 allows completion fluids 12, such as gravel pack fluids, to enter into passage 34 through openings 44 and bypass first packing element 37 to gravel pack resource bearing zone 16.

Figure 4:
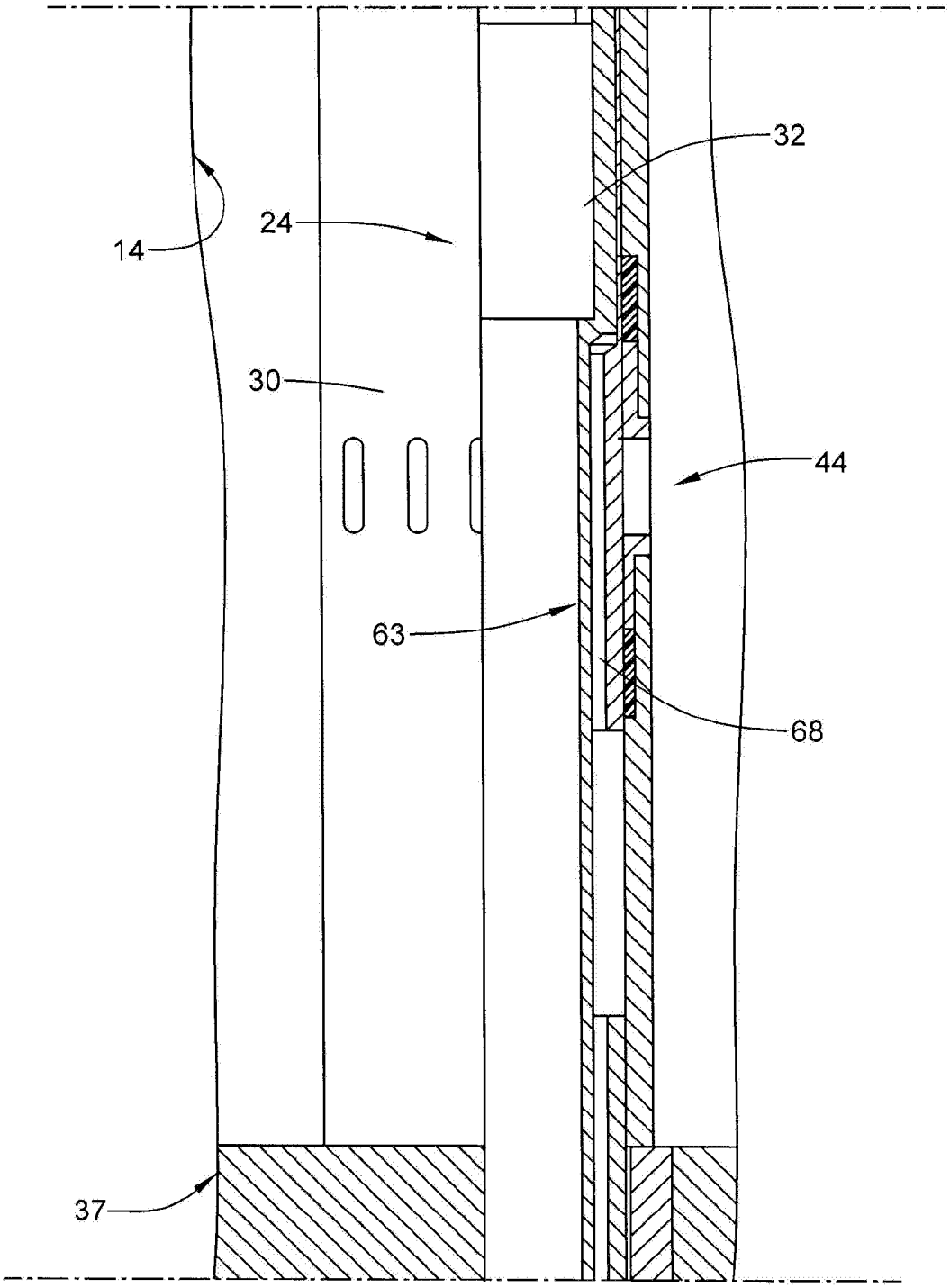
FIG. 4 depicts a partial cross-sectional view of the multi-zone single treatment gravel pack system of FIG. 1 after gravel packing.
Figure 5:
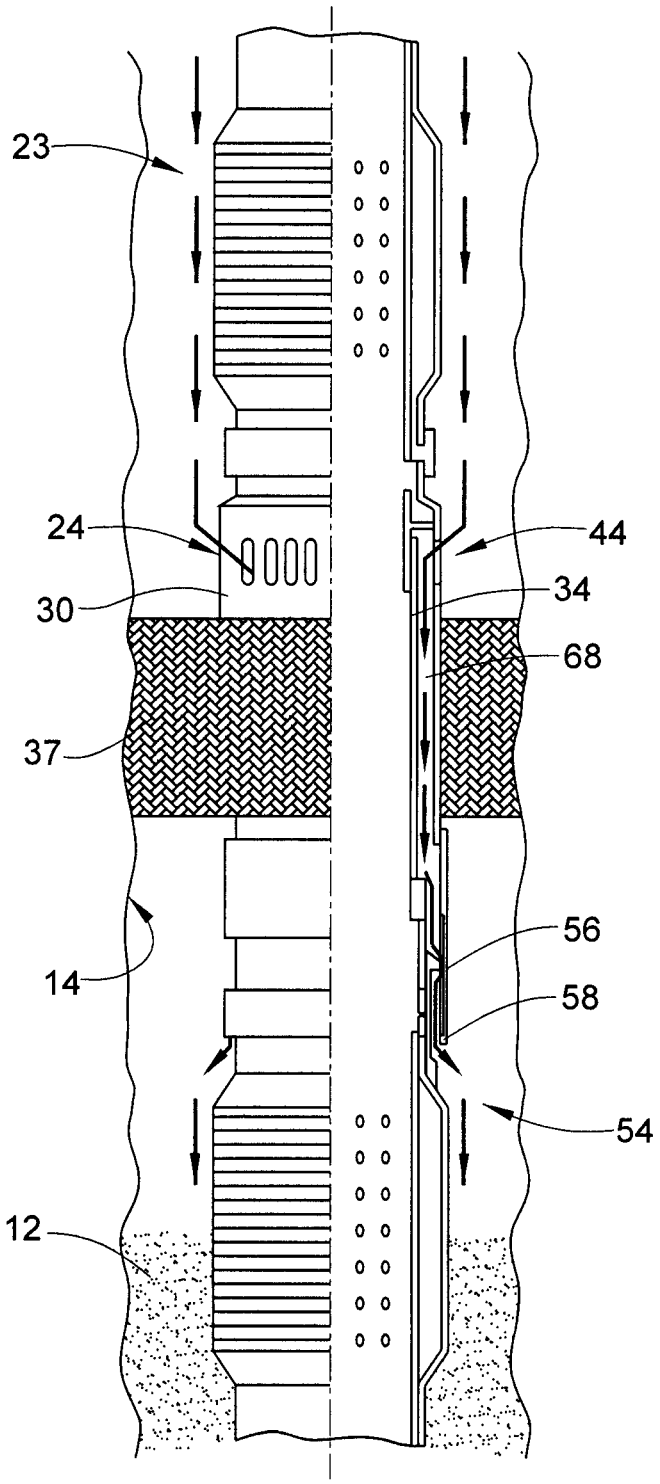
FIG. 5 is a partial cross-sectional view of a gravel packing fluid passing about a packing element through the multi-zone single treatment gravel pack system of the exemplary embodiment.
Figure 6:
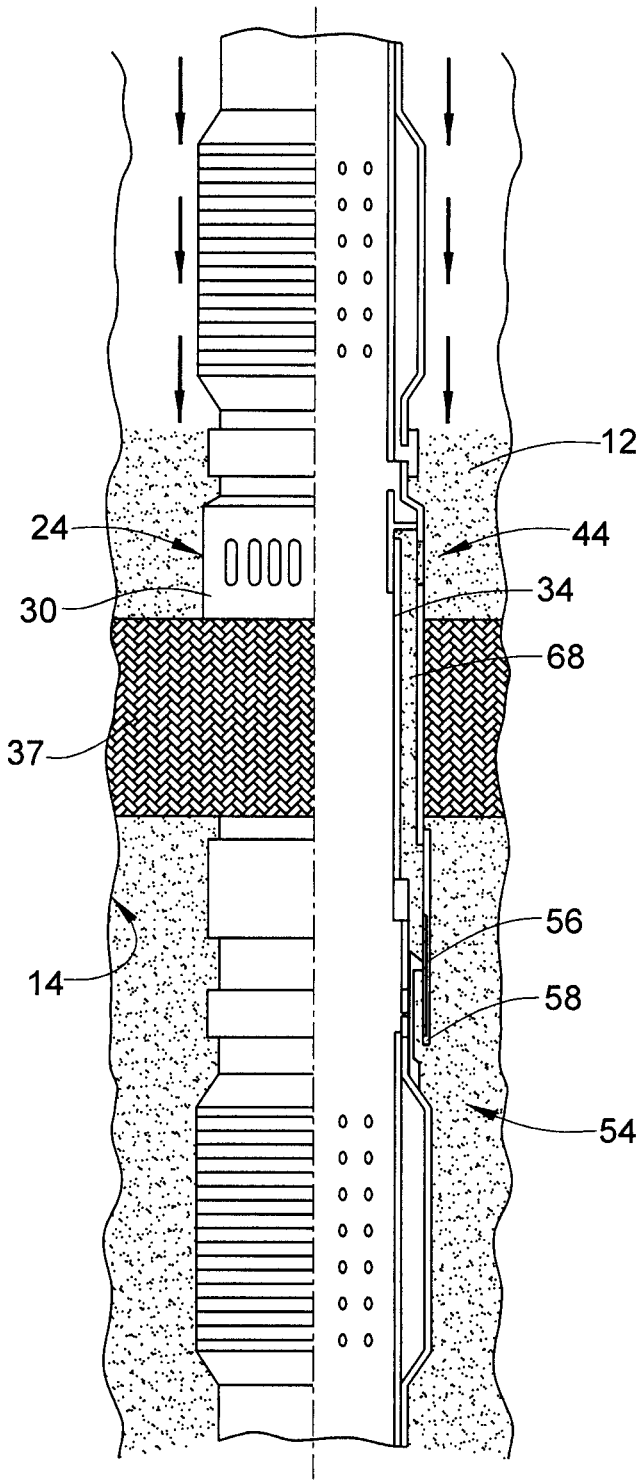
FIG. 6 is a partial cross-sectional view of a gravel packing fluid filling a wellbore above the packing element of FIG. 5.

More specifically, after multi-zone single treatment gravel pack system 23 is guided into a desired position in open hole wellbore 14 and packing element 37 is set isolating resource bearing zone 15 from resource bearing zone 16, as shown in FIG. 5. After packing element 37 is set, first valve 54 is opened allowing completion fluids 12 to flow into resource bearing zone 16. Gravel (not separately labeled) in completions fluids 12 accumulates in resource bearing zone 16. After completing gravel packing in resource bearing zone 16, gravel will begin to accumulate in resource bearing zone 15 as shown in FIG. 6. Once gravel packing is complete in resource bearing zone 15 a shifting tool (not shown), run on the end of a wash pipe (also not shown), may be employed to close second valve 63, as shown in FIG. 4.

Figure 7:
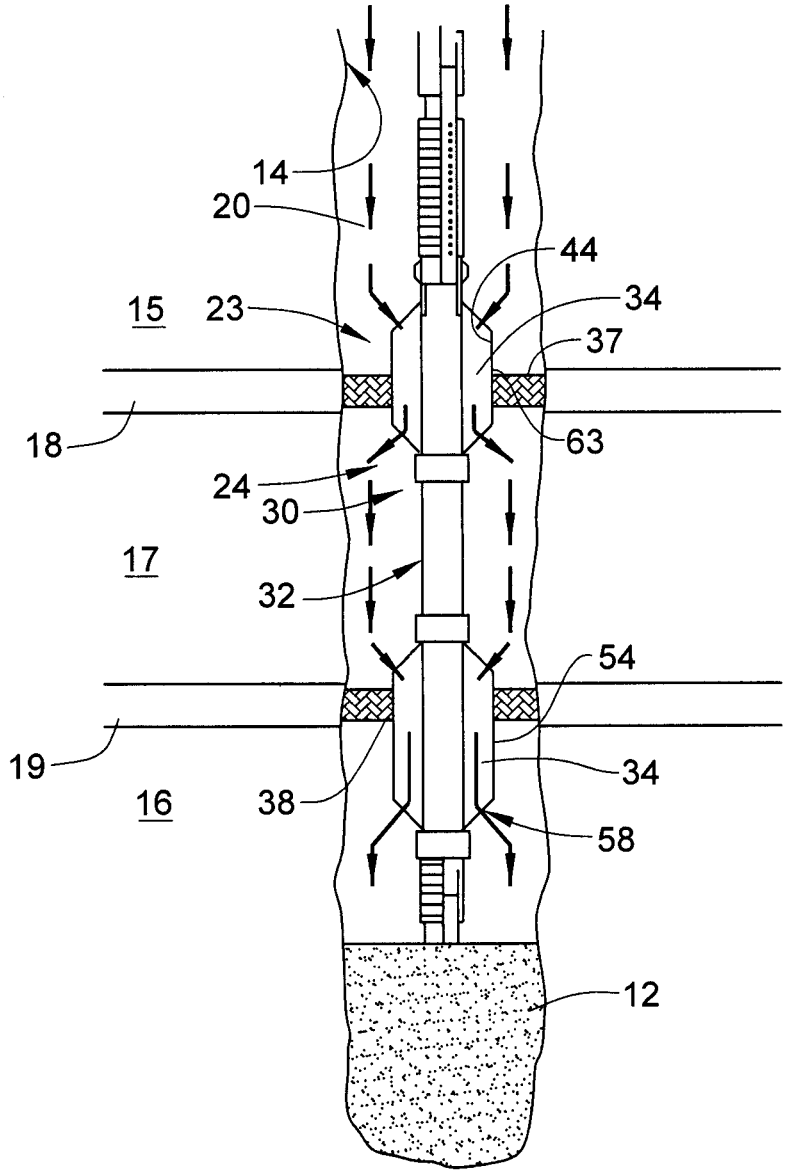
FIG. 7 depicts a schematic view of the gravel pack system illustrating gravel pack fluid flowing to desirable and undesirable zones through the multi-zone single treatment gravel pack system.
Figure 8:
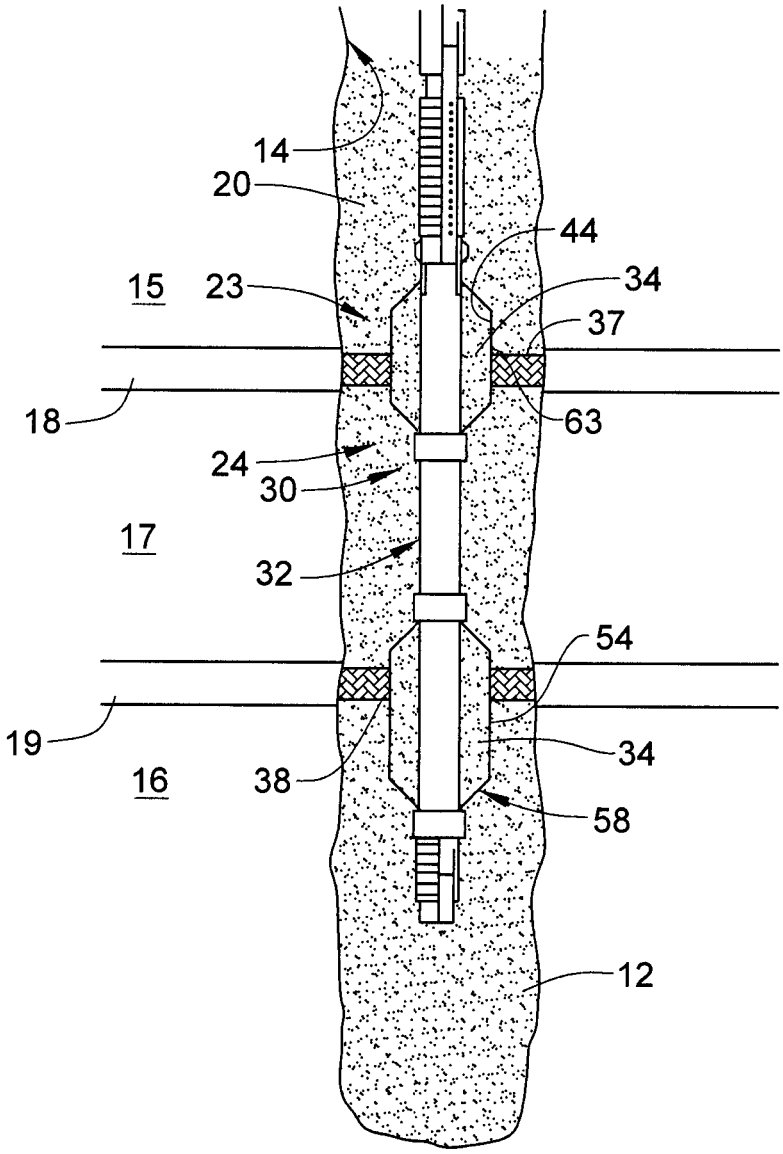
FIG. 8 depicts a schematic view of the multi-zone single treatment gravel pack system illustrating gravel pack fluids flowing above the undesirable zone, in accordance with an exemplary embodiment.

At this point, it should be understood that exemplary embodiments describe a system for performing a multi-zone single treatment gravel pack operation after a zonal isolation operation. In this manner, packing element(s) may be set against non-gravel pack surfaces to provide better sealing. It should be further understood, that gravel packing of multiple zones may be completed in a single operation without the need for shunts, shunted screens, or multiple tool insertion and withdrawal operations. Also, it should be understood, that while described in terms of performing a gravel pack operation, across a single packing element, the multi-zone single treatment gravel pack system may be employed to conduct completion fluids across resource bearing zones 15 and 16 and non-resource bearing zones 17 such as shown in FIGS. 7 and 8 separated by a first packing element 37 and a second packing element 38. Further, it should be understood that in addition to gravel pack fluid, other completion and/or production fluids may be passed into multiple zones without the need for multiple operations The multi-zone gravel pack system makes uses of an isolation packing element that allows performing a multi-zone gravel pack treatment in one continuous pumping operation. The packing element is set prior to pumping operation. During gravel pack the sand slurry is able to flow through the set packing element and upon completion of the treatment the valve above the packing element is closed thus isolating adjacent zones from each other without leaks.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A multi-zone single treatment gravel pack system comprising:

a tool string including an inner string member, an outer string member, and a passage arranged between the outer string member and the inner string member;

at least one selectively deployable packing element provided on the outer string member;

a first valve coupled to one of the outer string member and the inner string member outwardly of the at least one selectively deployable packing element in a downhole direction, the first valve selectively fluidically connecting the passage and an open hole wellbore, the first valve being configured and disposed to shift from a closed position to an open position; and a second valve coupled to one of the outer string member and the inner string member outwardly of the at least one selectively deployable packing element in an uphole direction, the second valve selectively fluidically connecting the passage and the open hole wellbore, the second valve being configured and disposed to shift from an open position to a closed position, wherein the open hole wellbore uphole of the at least one selectively deployable packing element is selectively fluidically connected with the open hole wellbore downhole of the selectively deployable packing element through the passage.

2. The multi-zone single treatment gravel pack system according to claim 1, wherein the first valve includes a shroud member configured and disposed to direct fluid outwardly and downwardly from the outer string member into the open hole wellbore.

3. The multi-zone single treatment gravel pack system according to claim 1, wherein the outer string member includes a plurality of openings.

4. The multi-zone single treatment gravel pack system according to claim 3, wherein the inner string member comprises a selectively shiftable isolation sleeve, the second valve being formed on the isolation sleeve.

5. The multi-zone single treatment gravel pack system according to claim 1, wherein the at least one packing element includes a first packing element and a second packing element spaced from the first packing element.

6. A completion system comprising:

an uphole portion including at least one pump and a fluid storage system fluidically connected to the at least one pump; and a downhole portion including a completion string extending into an open hole wellbore, the completion string including a multi-zone single treatment gravel pack system comprising:

a tool string including an inner string member, an outer string member, and a passage arranged between the outer string member and the inner string member;

at least one selectively deployable packing element provided on the outer string member;

a first valve coupled to one of the outer string member and the inner string member axially outwardly of the at least one selectively deployable packing element in a downhole direction, the first valve selectively fluidically connecting the passage and the open hole wellbore the first valve being configured and disposed to shift from a closed position to an open position; and a second valve coupled to one of the outer string member and the inner string member axially outwardly of the at least one selectively deployable packing element in an uphole direction, the second valve selectively fluidically connecting the passage and the open hole wellbore, the second valve being configured and disposed to shift from an open position to a closed position, wherein the open hole wellbore uphole of the at least one selectively deployable packing element is selectively fluidically connected with the open hole wellbore downhole of the selectively deployable packing element through the passage.

7. The completion system according to claim 6, wherein the first valve includes a shroud member configured and disposed to direct fluid outwardly and downwardly from the outer string member into the open hole wellbore to reduce wellbore wall erosion.

8. The completion system according to claim 6, wherein the outer string member includes a plurality of openings.

9. The completion system according to claim 8, wherein the inner string member comprises a selectively shiftable isolation sleeve, the second valve being formed on the isolation sleeve.

10. The completion system according to claim 6, wherein the at least one packing element includes a first packing element and a second packing element spaced from the first packing element.

11. A method of multi-zone single treatment gravel packing an open hole wellbore comprising:

guiding a completion string including a gravel pack system into the open hole wellbore;

deploying at least one packing element provided on an outer string member to isolate a portion of the open hole wellbore;

opening a first valve arranged outwardly of the at least one packing element in a downhole direction;

introducing a downhole fluid into the open hole wellbore;

guiding the downhole fluid through openings formed in the outer string member outwardly of the at least one packing element in an uphole direction;

passing the downhole fluid radially inwardly along the at least one packing element through a passage arranged between the outer string member and an inner string member;

guiding the downhole fluid through the first valve back into the open hole wellbore; and closing a second valve arranged at the openings in the outer string member.

12. The method of claim 11, wherein closing the second valve includes shifting an isolation sleeve relative to the plurality of openings.

13. The method of claim 11, wherein deploying the at least one packing element includes deploying a first packing element arranged outwardly of an isolation sleeve in a downhole direction and deploying a second packing element arranged outwardly of the isolation sleeve in an uphole direction.

14. The method of claim 13, wherein passing the downhole fluid radially inwardly along the at least one packing element includes passing the downhole fluid radially inwardly of the first packing element and the second packing element.

15. The method of claim 14, wherein guiding the downhole fluid through the first valve back into the open hole wellbore includes gravel packing the open hole wellbore outwardly of the second packing element in the downhole direction.

16. The method of claim 15, further comprising: introducing the downhole fluid into the open hole wellbore outwardly of the second packing element in an uphole direction.

17. The method of claim 11, wherein guiding the downhole fluid through the first valve back into the open hole wellbore includes passing the downhole fluid along a shroud member outwardly and downwardly of the outer string member.

18. The method of claim 11, wherein closing a second valve includes guiding a shifting tool in an uphole direction to engage inner string member closing the openings.

* * * * *